United States Patent [19]

Uematsu

[11] Patent Number: 4,982,692

[45] Date of Patent: Jan. 8, 1991

[54] APPARATUS FOR LIQUID DEVELOPMENT OF ELECTROSTATIC LATENT IMAGES

[75] Inventor: Ryosuke Uematsu, Tokyo, Japan

[73] Assignee: NEC Corporation, Tokyo, Japan

[21] Appl. No.: 311,553

[22] Filed: Feb. 16, 1989

[30] Foreign Application Priority Data

Feb. 16, 1988 [JP] Japan ..... 63-34478
Feb. 16, 1988 [JP] Japan ..... 63-34492

[51] Int. Cl.[5] ..... G03G 15/10; G03G 17/04

[52] U.S. Cl. ..... 118/661; 355/256; 355/257; 355/259; 430/117

[58] Field of Search ..... 118/659, 661; 355/256, 355/257, 258, 259; 430/117, 118, 119

[56] References Cited

U.S. PATENT DOCUMENTS

| | | | |
|---|---|---|---|
| 3,776,630 | 12/1973 | Ohno et al. | 430/117 X |
| 3,817,748 | 6/1974 | Whittaker | 430/117 X |
| 3,830,199 | 8/1974 | Saito et al. | 118/661 |
| 3,906,896 | 9/1975 | Stansell | 118/661 |
| 3,973,955 | 8/1976 | Ohno et al. | 355/256 X |
| 3,991,711 | 11/1976 | Nakano et al. | 355/256 X |
| 4,023,898 | 5/1977 | Ohno et al. | 430/118 X |
| 4,024,838 | 5/1977 | Horie | 355/256 X |
| 4,058,637 | 11/1977 | Ohno | 430/118 |
| 4,202,620 | 5/1980 | Klavan et al. | 355/256 |
| 4,202,913 | 5/1980 | Klavan et al. | 118/661 X |
| 4,245,023 | 1/1981 | Cassiers et al. | 355/256 X |
| 4,268,597 | 5/1981 | Klavan et al. | 430/117 X |
| 4,493,550 | 1/1985 | Takekida | 355/256 |
| 4,942,475 | 7/1990 | Uematsu et al. | 355/256 |

*Primary Examiner*—R. L. Moses
*Assistant Examiner*—Matthew S. Smith
*Attorney, Agent, or Firm*—Sughrue, Mion, Zinn, Macpeak & Seas

[57] ABSTRACT

The invention relates to an apparatus for development of an electrostatic latent image formed on a carrier surface by a liquid developer. The apparatus has a developer carrier with a smooth surface to carry thereon the liquid developer, such as a rotating roller partially submerged int he liquid developer. When the image-carrying surface comes close to the surface of the developer carrier the electrostatic image attracts the developer liquid existing on the developer carrier surface. To ensure that the developer liquid rises and projects to reach the image-carrying surface exactly and exclusively in an area just opposite to the latent image, the smooth surface of the developer carrier is divided into a plurality of first regions which are provided by a first material and uniformly distributed over the entire area of the surface and a second region which is provided by a second material and occupies the spacings between the first regions, using a readily wettable material as the first material and a hardly wettable material as the second material, or an electrically conductive material as the first material and a dielectric material as the second material.

5 Claims, 4 Drawing Sheets

APPARATUS FOR LIQUID DEVELOPMENT OF ELECTROSTATIC LATENT IMAGES

BACKGROUND OF THE INVENTION

This invention relates to an apparatus for development of electrostatic latent images created, for example, in a copier or a printer.

In electrostatic recording or reproducing processes such as electrophotography, electrostatic recording and photocopying and ionography utilized in the current copiers, printers, etc., the fundamentals are creating an electrostatic latent image on a carrier surface and developing the latent image into a visible image by deposition of a colored substance. For creating an electrostatic latent image there are various methods such as, for example, selective discharge of a uniformly charged photoconductive carrier by exposure to light and impartment of a preformed electrostatic charge to a dielectric carrier with a multi-pin electrode or an ion discharge gate. Further, fixation of the developed image is performed in various ways depending on the relation between the ultimate recording medium and the carrier on which the latent image is formed. In some cases the ultimate recording medium itself is used as the carrier, and in some other cases the developed image is transferred onto the ultimate recording medium before fixation. However, irrespective of such variations it is indispensable and fundamentally invariable to develop an electrostatic latent image into a visible image by application of a colored developer.

The currently prevailing method of developing electrostatic latent images is the dry development method using a powder toner. A representative of the dry development method is the magnetic brush development method in which the toner is conveyed to the development zone by magnetic force. However, a disadvantage of the dry development method is that the apparatus is liable to be soiled with a cloud of the toner powder. Besides, the visible image formed of the powder toner has to be fixed to the recording medium by application of heat and/or pressure.

It is also possible to develop electrostatic latent images by a wet process using a liquid developer. In a popular wet development method the liquid developer is a dispersion of colored particles in an organic liquid of high resistivity. A recording medium with latent images thereon is immersed in the liquid developer, and development is effected by electrophoretic deposition of the colored particles on the latent images. To complete the development process the organic liquid must be evaporated from the recording medium. Therefore, it is necessary to take some measures for preventing concentration of the vapor of the organic liquid in or around the development apparatus. As another problem with this wet development method, it is often that some of the colored particles in the liquid developer adhere to the uncharged areas of the recording medium surface to result in smudging or discoloration of the background.

To solve such problems, U.S. Pat. No. 4,202,620 proposes a liquid development method which is characterized in that a film of a liquid developer on a solid surface is brought close to a carrier surface on which an electrostatic latent image is formed. Although the liquid developer film does not come into contact with the carrier surface, the electrostatic field created by the charge on the carrier surface raises a local bulge in the liquid film in the region opposed to the latent image, and a slender projection grows up from the bulge as the gap between the liquid film and the carrier surface narrows, until the peak of the projection touches the latent image. In this manner the liquid developer adheres to the carrier surface only in areas where latent images exist. Therefore, development is accomplished without smudging the background areas and without adhesion of excessive liquid medium. Besides, in this method it is possible to use an aqueous dispersion as the liquid developer to thereby avoid generation of a vapor of an organic solvent at the subsequent drying stage.

However, a shortcoming of this method resides in that the bulges in the liquid developer film are not always created at accurately desired locations. That is, each bulge is created at a location where the liquid film makes a tiny protuberance due to minute swaying of the free surface of the film with resultant concentration of the electrostatic field between that protuberance and the latent image on the carrier surface. Therefore, in a relatively large area opposed to a latent image to be developed into a uniformly solid black region the bulges in the liquid film are not uniformly distributed over that area, so that the developed image contains uncolored regions and does not become uniformly solid black. As another problem, once a bulge is created in the liquid film and a slender projection begins to grow up from the bulge, further concentration of the electrostatic field occurs in that location. Therefore, in an area opposed to a plurality of tiny and closely formed latent images it is seldom that a projection of the liquid film grows up for each of such latent images. Instead, it is likely that a first created projection alone continues to grow up and comes into contact with more than one of the closely formed latent images. For this reason it is difficult to clearly reproduce fine images without blurring and without destroying necessary spacings.

SUMMARY OF THE INVENTION

It is an object of the present invention to obviate the above described disadvantages of the known liquid development methods and provide an improved apparatus for liquid development of electrostatic latent images, which is of the type making development without direct contact of the image-carrying surface with a body of liquid developer and is capable of clearly and accurately reproducing either a relatively large image of a uniformly solid color or a very small and fine image.

The present invention provides an apparatus for liquid development of an electrostatic latent image, the apparatus having a carrier member with a smooth surface on which a liquid developer is to be carried for development of an electrostatic latent image formed on a surface of another carrier which can be brought close to the smooth surface of the developer carrier. According to the invention the smooth surface of the developer carrier comprises a plurality of first regions, which are spaced from each other and uniformly distributed over substantially the entire area of the smooth surface, and a second region which occupies the spacings between the first regions. The first regions are provided by a first material and the second region by a second material such that when the carrier surface with the electrostatic latent image thereon is brought close to the smooth surface of the developer carrier while the liquid developer exists on the smooth surface the liquid developer rises and projects toward the latent image exclusively in at least one of the first regions located opposite to the latent image.

In a preferred first embodiment of the invention the first regions of the smooth surface of the developer carrier are readily wettable with the liquid developer, whereas the second region is repellent to or hardly wettable with the liquid developer. Therefore, the liquid developer adheres to the developer carrier surface only in the wettable regions, and in each of the wettable regions the developer is in the form of a nearly semi-spherical droplet. That is, a suitable number of small protuberances of the liquid developer are formed in an area opposite to the latent image without relying on concentration of the electrostatic field between the image-carrying surface and the developer carrier surface. By virtue of this phenomenon, the disadvantages of the known apparatus in which a uniform film of liquid developer is on the developer carrier surface are negated, as will be explained hereinafter in detail.

In a preferred second embodiment of the invention the first regions of the development carrier surface are electrically conductive whereas the second region is dielectric. In this case a uniform film of liquid developer is formed on the developer carrier surface. However, electrostatic charges are provided to the conductive regions of the developer carrier surface. Therefore, when the image-carrying surface approaches the liquid developer film small protuberances are readily formed in the liquid film only on one or some of the conductive regions located opposite to the latent image. That is, this embodiment has the same merits as the first embodiment, as will be described hereinafter in detail.

DESCRIPTION OF THE PREFERRED EMBODIMENTS

Figure 1:
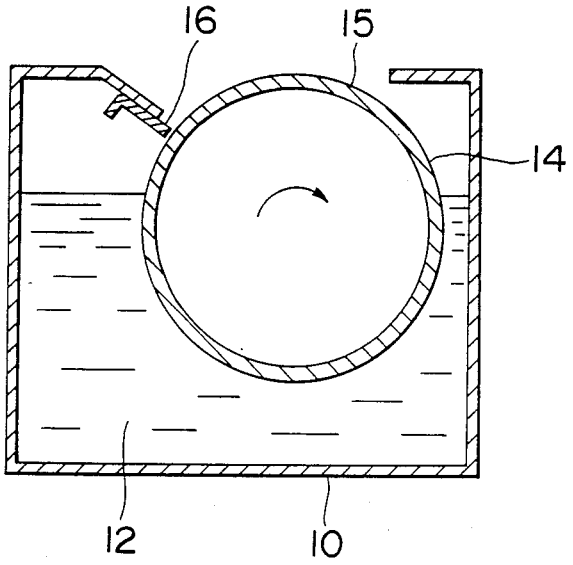
FIG. 1 is a sectional view of a liquid development apparatus in which the present invention is embodied.

FIG. 1 shows a liquid development apparatus as a component of an electrostatic copying or printing system. The apparatus has a developer tank 10 containing a liquid developer 12. The liquid medium of the developer 12 may be either water or an organic liquid, and the colored particles dispersed therein may be of any known various types. A developer roller 14 is rotatably supported in the tank 10 so as to partially submerge in the liquid developer 12. Numeral 16 indicates a doctor blade to assist forming a film of the developer liquid 12 on the exposed area of the cylindrical outer surface 15 of the roller 14. The tank 10 is open at the top so that a carrier (not shown) such as a photoconductive drum, i.e. a rotating drum having a photoconductive surface, can be brought close to the outer surface 15 of the developer roller 14.

Figure 2:
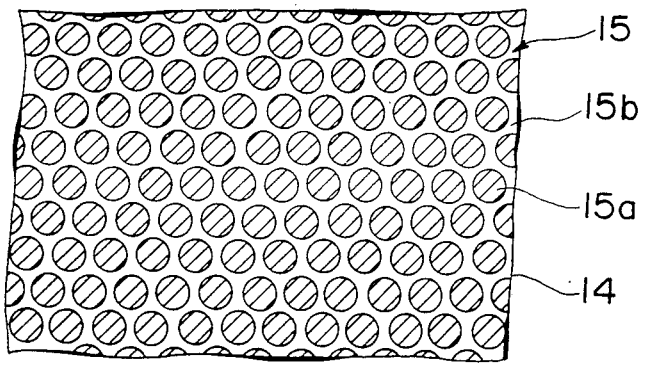
FIG. 2 is a fragmentarily enlarged plan view of the surface of a developer roller used in the apparatus of FIG. 1 as an embodiment of the invention.

Referring to FIG. 2, as a first embodiment of the invention the cylindrical outer surface 15 of the developer roller 14 consists of a multiplicity of small circular regions 15*a* which are well wettable with the liquid developer 12 and another region 15*b* which occupies spacings between the circular regions 15*a* and is repellent to or hardly wettable with the liquid developer 12. The circular regions 15*a*, which will be called liquid-philic regions, are uniformly distributed over substantially the entire area of the surface 15, and each of these regions 15*a* is surrounded by the other region 15*b*, which will be called liquid-phobic region. For example, the liquid-philic regions 15*a* are provided by a metallic material such as stainless steel, whereas the liquid-phobic region 15*b* is provided by a fluororesin such as polytetrafluoroethylene (PTFE). Usually both the diameter of each liquid-philic region 15*a* and the spacing between two adjacent liquid-philic regions 15*a* are of the order of $10^{-2}$ mm. For example, the diameter is about 30 $\mu$m and the spacing is about 60 $\mu$m.

Since the roller surface 15 is formed of the two kinds of materials greatly different in wettability, a uniform film of the liquid developer 12 is not formed on the roller surface 15 even though the doctor blade 16 is used. The liquid developer 12 adheres to the roller surface 15 only in the circular liquid-philic regions 15*a*.

Figure 3A:
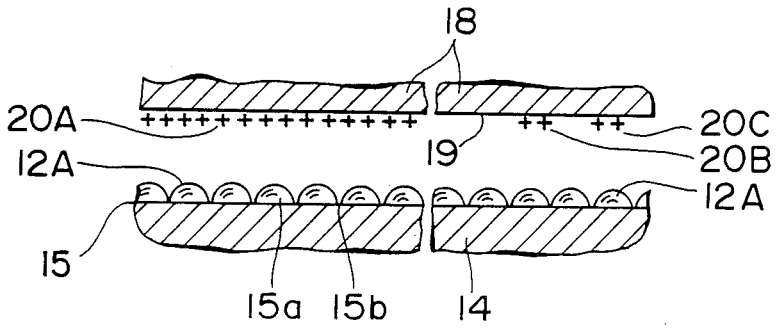
FIGS. 3(A) to 3(C) explanatorily illustrate the process of developing electrostatic latent images by using the developer roller of FIG. 2.

FIG. 3(A) shows a surface portion of the developer roller 14 and a surface portion of a photosensitive drum 18 arranged parallel to the roller 14 in an enlarged sectional view taken along the axes of the roller and the drum. As illustrated, in each of the liquid-philic regions 15*a* of the developer roller surface 15 the liquid developer bulges in the form of a nearly semi-spherical droplet 12A. In the left-hand section the cylindrical outer surface 19 of the photoconductive drum 18 is charged with uniform distribution of potential so as to form a relatively large electrostatic latent image 20A which is to be developed into a solid black region. In the right-hand section there are two small electrostatic latent images 20B and 20C which are close to each other. In FIG. 3(A) it is assumed that the electrostatic charges on the drum surface 19 do not yet affect the liquid droplets 12A on the developer roller surface 15.

Figure 3B:
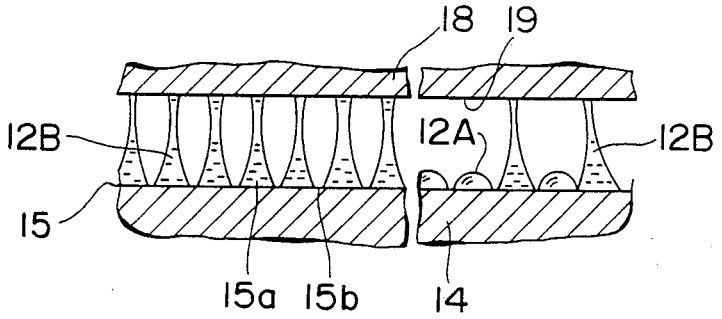
Figure 3C:
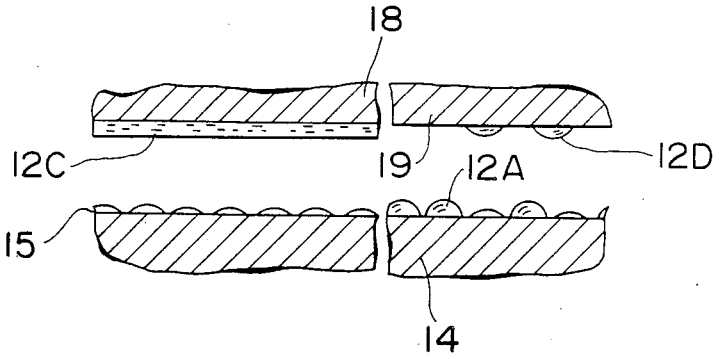

Referring to FIG. 3(B), as the photoconductive drum 18 further approaches the developer roller surface 15 the electrostatic latent images 20A, 20B, 20C on the drum surface 19 attract the liquid droplets 12A on the roller surface 15. As mentioned hereinbefore, the electrostatic field created by the latent images tends to concentrate at some locations where the liquid developer makes protuberances by chance. However, on the developer roller surface 15 according to the invention the unifomly distributed protuberances 12A of the liquid developer are formed in advance. Therefore, in the area opposed to the large latent image 20A a slender projection 12B grows up from every liquid droplets 12A in the liquid-philic regions 15*a* to reach the drum surface 19. As a consequence, as illustrated in FIG. 3(C), the large latent image 20A is covered with a uniform film 12C of the liquid developer, whereby the the latent image 20A is developed into a solid black (or any other color) image containing no uncolored areas. In the area opposed to the closely located two small latent images 20B and 20C, one or only a few of liquid droplets 12A located just opposite to each latent image 20B, 20C are attracted to form slender projections 12B which come into contact with the individual latent images 20B, 20C. As a consequence each of the small latent image 20B, 20C is covered with an independent droplet 12D of the liquid developer as illustrated in FIG. 3(C), whereby the two closely located small images are individually developed with very good resolution without blurring and without destroying the narrow spacing between the two images.

Figure 4:
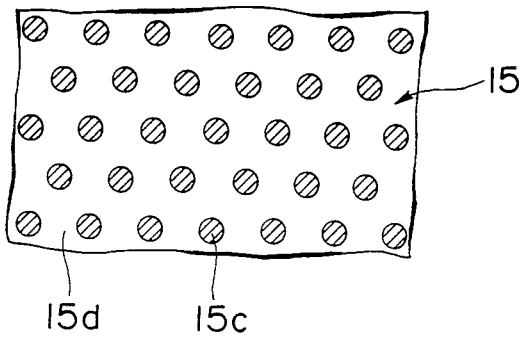
FIG. 4 is a fragmentrarily enlarged plan view of the surface of another developer roller as a second embodiment of the invention.
Figure 5:
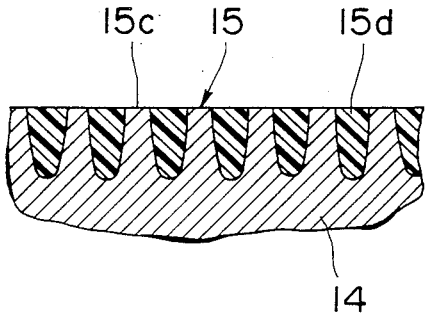
FIG. 5 is a fragmentarily enlarged sectional of the developer roller of FIG. 4.

FIGS. 4 and 5 show another embodiment of the invention with respect to the developer roller 14 in FIG. 1. In this embodiment the roller surface 15 consists of a multiplicity of small circular regions 15*c* which are provided by an electrically conductive material and another region 15*d* which occupies the spacings between the circular regions 15*c* and is provided by a dielectric material. The circular regions 15*c*, which will be called conductive regions, are uniformly distributed over substantially the entire area of the surface 15, and each of these regions 15*c* is surrounded by the other region 15*d*, which will be called a dielectric region. For example, the conductive regions 15*c* are provided by a metal material such as stainless steel, whereas the dielectric region 15*d* is provided by a synthetic resin such as PTFE or an epoxy resin. The developer roller 14 having such a surface can be produced by the steps of preparing a metal roller having a uniform and even outer surface, forming a multiplicity of recesses in the roller surface by a suitable method such as selective etching, then filling up the recesses with a synthetic resin and finally polishing the roller surface. The developer roller surface 15 shown in FIG. 2 too can be produced by a similar method.

The diameter of each conductive region 15*c* and the spacing between two adjacent conductive regions 15*c* are similar to the diameter and spacings of the liquid-philic regions 15*a* in the first embodiment described with reference to FIG. 2.

In the developer tank 10 the conductive regions 15*c* of the developer surface 15, i.e. the body of the roller 14, is connected to a power supply (not shown) which provides a biasing potential for liquid development.

Figure 6A:
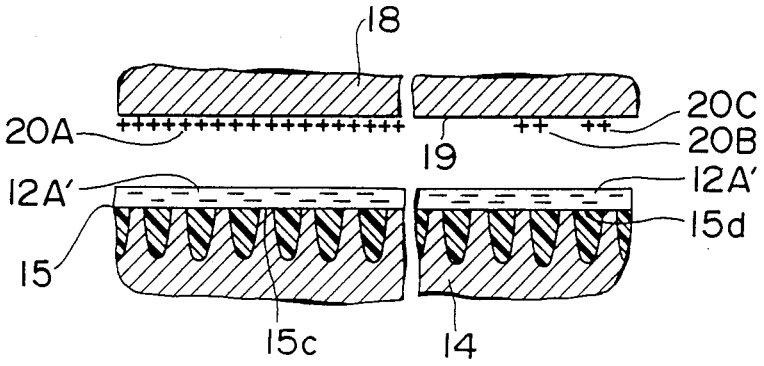
FIGS. 6(A) to 6(C) explanatorily illustrate the process of developing electrostatic latent images by using the developer roller of FIGS. 4 and 5.

FIG. 6(A) shows a surface portion of the developer roller 14 having the surface 15 of FIGS. 4 and 5 and a surface portion of the photosensitive drum 18 described hereinbefore in an enlarged sectional view corresponding to FIG. 3(A). As illustrated, a uniform film 12A' is formed on the developer roller surface 15. In the left-hand section the outer surface 19 of the photoconductive drum 18 is charged with uniform distribution of potential so as to form a relatively large electrostatic latent image 20A which is to be developed into a solid black region. In the right-hand section there are two small electrostatic latent images 20B and 20C which are close to each other. In FIG. 6(A) it is assumed that the electrostatic charges on the drum surface 19 do not yet affect the liquid film 12A' on the developer roller surface 15.

Figure 6B:
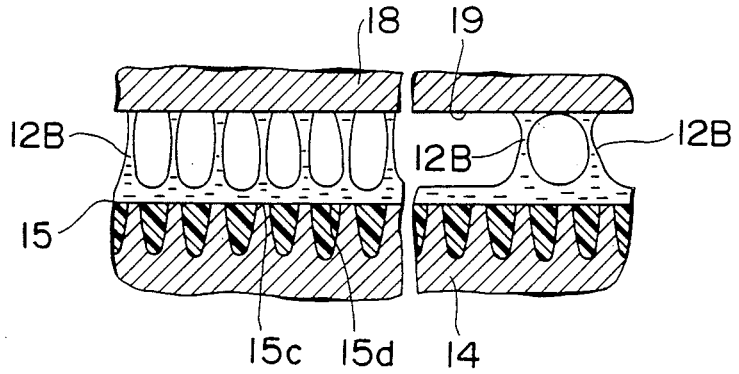
Figure 6C:
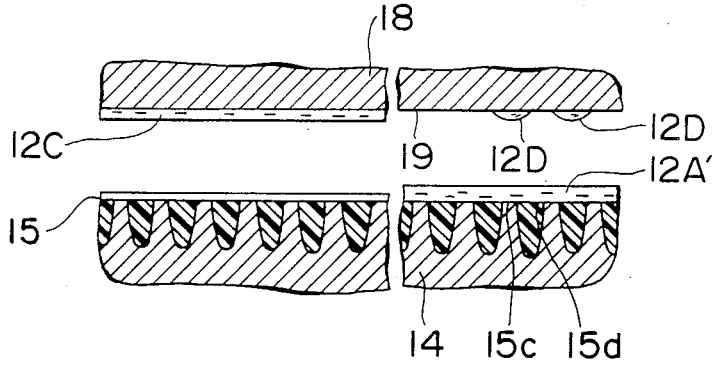

Referring to FIG. 6(B), as the photoconductive drum 18 further approaches the developer roller surface 15 the intensity of the electric field between the two surfaces 19 and 15 augments, so that slender projections 12B grow up from the liquid film 12A' on the roller surface 15. Since charges are supplied to the liquid developer film 12A' via the conductive portions 15*c* of the roller 14, the projections 12B are liable to be produced in the conductive regions 15*c* located opposite to the respective latent images 20A, 20B, 20C. In the area opposed to the large latent image 20A a slender projection 12B grows up from the liquid film 12A' on each of the conductive regions 15*c* which are distributed in a uniform pattern. Therefore, as illustrated in FIG. 6(C), the large latent image 20A is covered with a uniform film 12C of the liquid developer, whereby the the latent image 20A is developed into a solid color image containing no uncolored areas. In the area opposed to the closely located two small latent images 20B and 20C, one or a few of projections 12B grow up from the liquid film 12A' on the conductive regions 15*c* located just opposite to each latent image 20B or 20C. As a consequence each of the small latent images 20B, 20C is covered with an independent droplet 12D of the liquid developer as illustrated in FIG. 6(C), whereby the two closely located small images are individually developed clearly and accurately without blurring and without destroying the narrow spacing between the two images.

What is claimed is:

1. In an apparatus for liquid development of an electrostatic latent image, the apparatus having a carrier member having a smooth surface on which a liquid developer is to be carried for development of an electrostatic latent image formed on a surface of another carrier which can be brought close to the smooth surface of said carrier member, the improvement comprising said smooth surface comprising a plurality of first regions, which are spaced from each other and uniformly distributed over substantially the entire area of said smooth surface, and a second region which occupies the spacings between said first regions, said first regions being provided by an electrically conductive material and electrically connected to a power supply which provides a biasing potential for liquid development, said second region being provided by a dielectric material.

2. An apparatus according to claim 1, wherein said conductive material is a metal and said dielectric material is a synthetic resin.

3. An apparatus according to claim 2, wherein said synthetic resin is a fluororesin.

4. An apparatus according to claim 1, wherein said first regions are circular regions having approximately the same diameter.

5. An apparatus according to claim 4, wherein both the diameter of each of said first regions of said smooth surface and the spacing between two adjacent first regions are of the order of $10^{-2}$ mm.

* * * * *

UNITED STATES PATENT AND TRADEMARK OFFICE

CERTIFICATE OF CORRECTION

PATENT NO. : 4,982,692

DATED : January 8, 1991

INVENTOR(S) : Uematsu

It is certified that error appears in the above-identified patent and that said Letters Patent is hereby corrected as shown below:

IN THE ABSTRACT:

Line 6, delete "int he" insert --in the--.

Col. 3, line 44, delete "fragmentrarily" insert --fragmentarily--.

Col. 4, line 55, delete "unifomly" insert --uniformly--.

Signed and Sealed this

Seventh Day of July, 1992

*Attest:*

DOUGLAS B. COMER

*Attesting Officer*

*Acting Commissioner of Patents and Trademarks*